United States Patent [19]

Schultz et al.

[11] Patent Number: 4,578,123

[45] Date of Patent: Mar. 25, 1986

[54] METHOD FOR MANUFACTURING A METALLIC BODY USING AN AMORPHOUS ALLOY

[75] Inventors: Ludwig Schultz, Bubenreuth; Franz Gaube, Herzogenaurach, both of Fed. Rep. of Germany

[73] Assignee: Siemens Aktiengesellschaft, Munich, Fed. Rep. of Germany

[21] Appl. No.: 731,507

[22] Filed: May 7, 1985

[30] Foreign Application Priority Data

May 16, 1984 [DE] Fed. Rep. of Germany ..... 3418209

[51] Int. Cl.[4] ..... C22C 1/00

[52] U.S. Cl. ..... 148/11.5 Q; 148/403

[58] Field of Search ..... 148/11.5 Q, 11.5 R, 148/403

[56] References Cited

FOREIGN PATENT DOCUMENTS

WO84/02926 8/1984 PCT Int'l Appl. ..... 148/403

OTHER PUBLICATIONS

Schwarz et al.; Journal of Non-Crystalline Solids 61 & 62; pp. 129-134; 1984; North-Holland, Amsterdam.

Koch et al.; Appl. Phys. Lett. (11), vol. 43; pp. 1017-1019; 12/1983; American Institute of Physics.

Clemens et al.; Journal of Non-Crystalline Solids 61 & 62; pp. 817-822; 1984, North-Holland, Amsterdam.

Schwarz et al.; Physical Review Letters; vol. 51, No. 5; pp. 415-418; 1983.

*Primary Examiner*—Wayland Stallard

*Attorney, Agent, or Firm*—Kenyon & Kenyon

[57] ABSTRACT

A metallic body, such as a metallic glass body, is manufactured from an amorphous alloy formed from at least two starting alloy partners. First, a preliminary product is produced having respective adjacent layer of the starting alloy partners. A non-crystalline intermediate product is then developed by a rapid diffusion reaction at a predetermined relatively low temperature. The intermediate product is then further processed to form the metallic body which may be amorphous or crystalline in structure. Large scale production of such metallic bodies with relatively large thicknesses is made possible. For this purpose, a starting product is formed by joining together a predetermined number of mutually adjacent individual parts of the respective starting alloy partners by means of a bundling or stacking technique. The preliminary product with predetermined adjacent layer thicknesses is then produced from the starting product by subjecting the starting product to at least one cross-section reducing deformation treatment.

18 Claims, No Drawings

METHOD FOR MANUFACTURING A METALLIC BODY USING AN AMORPHOUS ALLOY

FIELD OF INVENTION

The invention relates to a method for manufacturing a metallic body, e.g., a metallic glass body, from an amorphous alloy formed by at least two predetermined starting elements or compounds. The method of the present invention relates to methods wherein a preliminary product is made having respectively adjacent layers of the starting elements or compounds with a respective layer thickness of at most 0.001 mm. Subsequently, an intermediate product having a noncrystalline or amorphous structure is developed from the preliminary product by a rapid (fast) diffusion reaction at a predetermined relatively low temperature. Finally, this intermediate product is further processed into the metallic body. Such a general method is disclosed for instance, in "Frankfurter Zeitung: A Review of the Economy"; publisher: "Frankfurter Allgemeine Zeitung" vol. 27, no. 23, Feb. 1, 1984, page 5.

BACKGROUND OF THE INVENTION

Materials called "metallic glasses" or amorphous metals are generally known (see, for instance, "Zeitschrift für Metallkunde", vol. 69, 1978, no. 4, pages 212 to 220 or "Elektrotechnik und Maschinenbau", vol. 97, September 1980, 23 no. 9, pages 378 to 385). These materials are generally special alloys which are prepared by means of special processes from at least two predetermined starting elements or alloys also called alloy partners. These special alloys exhibit a vitreous amorphous structure instead of the crystalline structure of conventional metals and therefore have properties or property combinations which are superior to those of crystalline metallic materials. Metallic glasses can excel over conventional crystalline alloys particularly by exhibiting high wear and corrosion resistance, great hardness and tensile strength with simultaneously good ductility, as well as by possessing special magnetic properties.

Metallic glasses have heretofore generally been produced by rapid quenching from the melt. The rapid quenching method requires, however, that at least one dimension of the material is smaller than about 0.1 mm. It has further been proposed to produce metallic glasses by a solid state reaction if one of the alloy partners diffuses quickly into the other, while the other partner is practically immobile at a predetermined, relatively low temperature. Such a diffusion reaction is also generally called anomalous fast diffusion. For such a reaction, certain energy conditions must be present (see, for instance, "Physical Review Letters", vol. 51, no. 5, August 1983, pages 415 to 418, or "Journal of Non-Crystalline Solids", 61 and 62, 1984, pages 817 to 22). Thus, particularly, an exothermic reaction of the two alloy partners must be assumed.

In the fast diffusion method, layers of the alloy partners less than 0.001 mm thick are stacked alternatingly on top of each other and the so-developed sandwich-like preliminary product is heated at temperatures typical of the method which is between 100 and 300° C. An intermediate product is formed as semi-finished material being a thin layer of the noncrystalline structure of the metallic glass. Subsequently, this semi-finished material can then be processed from the very thin metallic glass into a metallic body as the end product, in a manner known per se.

However, it would be desirable for various applications if metallic glasses in any form and dimension, especially with larger thicknesses, were available. In order to obtain such thicker metallic glasses, it has been proposed for fast diffusion method applications to mix metal powders in the desired composition, to compact them by deformation, and to convert the preliminary product so formed by fast anamalous diffusion into the desired intermediate product (see, for instance, the prior cited publication "A Review of the Economy"). With this method, however, several difficulties arise. The oxide layers found on the surface of the metal powders must be removed by the deformation. In addition, the structure resulting from the compacting and deformation is very irregular.

OBJECTS OF THE INVENTION

It is an object of the present invention to provide a diffusion method for the manufacture of metallic bodies of relatively large shape and dimensions on a large technical scale using amorphous alloys or metallic glasses.

These and other objects of the present invention will become apparent from the following description and claims.

SUMMARY OF THE INVENTION

According to the present invention, a starting product is placed together by means of a bundling or stacking technique from a predetermined number of mutually adjacent individual parts of the respective starting elements or compounds, i.e., alloy partners. A preliminary product with predetermined layer thicknesses is then produced from this starting product by at least one cross section-reducing deformation treatment.

The advantages connected with this embodiment of the method according to the invention are seen particularly in the fact that due to the bundling or stacking technique, which is known per se, it is possible in a relatively simple manner to obtain the desired amorphous alloys having a large thickness. Appropriate bundling or stacking techniques are generally known, for instance, for producing superconductors. See, for instance, U.S. Pat. Nos. 3,218,693; 3,296,684; 3,273,092 or 3,465,430 the disclosures of which are incorporated herein by reference.

Further advantageous embodiments of the method according to the invention are hereinafter described.

DETAILED DESCRIPTION

In the manufacture of a metallic glass, the predetermined starting elements or compounds need not all be absolutely metallic but can also be in part metalloids.

The metallic glass to be manufactured has a mean composition $A_xB_y$, where A and B are, e.g., crystalline metallic starting elements or alloy partners, and x and y are mean atom percent. Commercially available foils of the metals A and B having a thickness between 0.001 mm and 1 mm, and preferably a thickness between 0.01 and 0.1 mm, are used for building up the starting product. The mean composition of the alloy AB is fixed by the ratio of the thickness of the foils A and B. Instead of one foil each of the metal A or B, several stacked-up foils of a metal can be also used to set the correct or desired layer thicknesses of the respective metals. After they have been stacked in a suitable manner, these foils are now deformed to thicknesses between 0.00005 and 0.001 mm and preferably between 0.0001 and 0.0005 mm because the diffusion lengths are very small with the available temperatures which, as is well known, are below the crystallization temperature of the respective metallic glass AB to be manufactured. The degree of deformation required in the deformation corresponds to the ratio of the starting foil thickness to the layer thickness desired for the diffusion anneal.

The bundling technique in each case then depends on the required degree of deformation as well as on the desired deformation of the starting product. Under some circumstances, multiple bundling is desired. The first bundling can be carried out either by alternating stacking up foils of the metals A and B cut appropriately, or by winding up the stacked-up foils. In the latter case the winding-up can be either oval or circular. These foil bundles can therefore comprise any number of double foil layers, taking into consideration the starting thickness of the foils and the desired final thickness of the bundle after the deformation. Typical values are between 50 and 500 layers. The foil bundles are then advantageously placed in a suitable envelope, for instance, of steel or copper, prior to being deformed.

Bundling by alternating stacking or oval winding-up of the foils is particularly well suited for producing a sheet of metallic glass. The deformation is advantageously carried out by rolling. The envelope of the preliminary product so produced can then be removed either mechanically or chemically after the deformation.

Bundling by circular winding-up is suitable for producing an intermediate body of the metallic glass in the form of a wire or rod. To this end, the foil bundle forming the starting product including the envelope is deformed by hammering, wire-drawing or profile-rolling to the desired diameter of the preliminary product to be produced. In this manner, noncircular profiles can also be made.

If, after these deformation steps are completed, either the individual coils are still too thick to make possible a complete diffusion reaction in a reasonable time or if larger final dimensions of the intermediate product are desired, a second bundling step can optionally follow, after which the desired form of the intermediate product can then be produced.

For manufacturing metal sheets, the above-mentioned techniques can be employed appropriately by using foil bundles already deformed in the starting product instead of the double layers of the metal foil A and B. Any desired number of layers can again be bundled here in one envelope. However, attention must be given to insure that the subsequent deformation for producing the preliminary product by rolling is sufficient for good compacting. Wires or rods can be produced in a second bundling step either in accordance with the above-mentioned technique by circular winding-up or by bundling the wires produced in the first bundling step in an envelope and by suitable deformation.

For producing tubes, the foil bundle generated in a first bundling step is wound on a thin tube, for instance, of steel and is then pushed into a second tube as an envelope. The deformation into the preliminary product is then effected by tube-drawing or tube hammering. The cladding tubes can be removed again mechanically or chemically after the deformation is completed.

Under special circumstances, an envelope for the first or second bundle can also be dispensed with.

If, after the termination of the deformation, the desired preliminary product with the predetermined layer thicknesses is produced from the starting elements or compounds, this preliminary product is converted into the intermediate product by a suitable heat treatment, utilizing the anomalous fast diffusion in the known manner (see the cited literature references "Phys. Rev. Lett." or "J. Non-Cryst. Sol."). It should be noted here that, the finer the structure, lower temperatures or shorter annealing times for complete conversion are sufficient. In any event, as is well known, the annealing temperature must be below the crystalization temperature of the metallic glass.

The method according to the invention can be used for all systems in which the amorphous phase can be generated in a fast diffusion reaction. Suitable element combinations in which anomalous fast diffusion occurs, are generally known (see, for instance, "Journal of Nuclear Materials", vol. 69 and 70, 1978, pages 70 to 96). The following are set forth as a particular example:

Ni, Co, Fe, Cu, Ag or Au in Ti, Zr, Hf, Nb, Y, La, Pb, Sn or Ge as well as in lanthanides or actinides;

B, C in Fe, Ni or Co.

Besides these element combinations, one or both partners can consist of a compound and in particular, of an alloy having several elements. As an example for this, B in FeNi can be given.

If only one of the two partners is deformable, the above-mentioned method can be modified in such a manner that the non-deformable partner is added in powder form. To this end, the powder is placed on the foil of the deformable partner, for instance, by sprinkling or spraying. The powder can be laid between two corresponding foils, or is rolled in. An example is FeNi-B, where the boron is not deformable.

The method according to the invention will be explained in further detail by the following examples in accordance with the invention.

EXAMPLE I

An amorphous Ni-Zr sheet is produced by this example of the present invention. Ni and Zr foils 0.025 mm thick are placed on top of each other and rolled to form an oval bundle which is then deformed by rolling in a steel jacket. The overall thickness is reduced in the process from 10 mm to 0.5 mm. In the process, the thickness of the individual foils is reduced to about 0.0012 mm. Then, the steel jacket is removed by chemical etching, for instance, with HCl. The composite Ni-Zr sheets are then bundled 19 times in a second bundling step in a steel jacket and are likewise deformed in the latter by rolling. The total thickness is again reduced here from 10 mm to 0.5 mm. The foil packet which is produced in this manner and serves as the preliminary product is then 0.25 mm thick, 10 mm wide and about 300 mm long. The individual foils are then between 0.0001 and 0.0005 mm thick. Annealing of this preliminary product for forming the intermediate product is carried out at temperatures between 180° C. and 400° C., and preferably between 250° C. and 350° C. for time periods of between 2 to 100 hours. This leads to the formation of the amorphous Ni-Zr. The formation of the amorphous state can be confirmed by x-ray examination.

EXAMPLE II

An amorphous Ni-Zr wire is manufactured in accordance with the present invention. The double layer of Ni and Zr is rolled-up to form a spiral with about 200 turns corresponding to Example I. This is then deformed in a round steel jacket by hammering and wire-drawing. In the process, the overall diameter is reduced from 15 mm to 0.6 mm. The steel jacket is then removed by etching with HCl. The thickness of the individual foils has been reduced here to about 0.001 mm. In a second bundling step, 91 of these composite foil wires are bundled again in a steel jacket with an outside diameter of 8 mm and they are deformed again by hammering and wire drawing to 1.2 mm. After the steel jacket is separated, Ni-Zr wires 0.8 mm thick remain as preliminary products. These wires can then react in a heat treatment corresponding to that of Example I to form the metallic glass.

According to the examples it was assumed that the metallic body to be produced exhibits in the end product an amorphous i.e., non-crystalline structure, and in particular, the structure of a metallic glass. However, the method according to the invention can also be employed particularly advantageously for producing micro-crystalline materials via the detour of the amorphous state. Accordingly, intermediate products, for instance, Nd-Fe-B alloys, can first be produced in amorphous structure form according to the invention. In a subsequent annealing treatment, this alloy is then crystallized. The microcrystalline structure so produced exhibits excellent hard-magnetic properties (see, for instance, "Applied Physics Letters", vol. 44, no. 1, January 1984, pages 148 and 149).

In the method according to the invention, it is not absolutely necessary to provide at least one of the starting elements or one of the starting compounds in foil form by stacking or bundling of foils. The starting product can be also formed by the bundling of rods or wires of the two starting elements or compounds. In addition, it is also possible to start out using tubes of one of the starting elements or one of the starting compounds which are filled with the other element or alloy. These tubes are then bundled in a manner known per se to form the starting product. The other starting element or the other starting alloy can here be present in solid form as a wire or a rod or also in powder form. One can also start out with a starting element in wire or rod form comprising one element or compound which is provided with a jacket-like layer of the at least one further element or at least one further compound. Appropriate bundling techniques suited for these methods are generally known, for instance, from superconductor technology.

Although preferred embodiments of the present invention have been described im detail, it is anticipated that modifications may be made by one skilled in the art all within the spirit and scope of the present invention as defined in the claims.

What is claimed is:

1. In a method for manufacturing a metallic body using an amorphous alloy formed by at least two predetermined starting alloy partners, said method including the steps of:

producing a preliminary product having respectively adjacent layers of said starting alloy partners with each said respective layer having a thickness of at most 0.001 mm;

developing from said preliminary product an intermediate product having a non-crystalline structure using a rapid diffusion reaction at a predetermined relatively low temperature; and then further processing said intermediate product to form said metallic body;

the improvement comprising:

forming a starting product by means of a bundling or stacking technique from a predetermined number of mutually adjacent parts of said respective starting alloy partners; and reducing the thickness of said starting product by at least one cross-section reducing treatment to provide said preliminary product having predetermined adjacent layer thicknesses.

2. A method according to claim 1 further comprising forming said starting product by multiple bundling or stacking of said starting alloy partners.

3. A method according to claim 1 wherein at least one of said starting alloy partners forming said starting product is provided in foil form.

4. A method according to claim 3 wherein all said starting alloy partners forming said starting product are provided in foil form.

5. A method according to claim 1 wherein at least one of said starting alloy partners forming said starting product is provided in the form of a wire or rod.

6. A method according to claim 5 wherein all of said starting alloy partners forming said starting product are provided in the form of a wire or rod.

7. A method according to claim 1 wherein at least one of said starting alloy partners forming said starting product is provided in tubular form and a core comprising at least another starting alloy partner fills said tubular form.

8. A method according to claim 7 wherein said at least another starting alloy partner core is a member selected from the group consisting of wire, rod and powder.

9. A method according to claim 5, wherein said one starting alloy partner in the form of a wire or rod is jacketed with another starting alloy partner.

10. A method according to claim 3 wherein another starting alloy partner in powder form is added to said at least one starting alloy partner in foil form.

11. A method according to claim 10 wherein said another starting alloy partner in powder form is sprayed onto said at least one starting alloy partner in foil form.

12. A method according to claim 10 wherein said another starting alloy partner in powder form is sprinkled onto said at least one starting alloy partner in foil form.

13. A method according to claim 10 wherein said another starting alloy partner in powder form is rolled onto said at least one starting alloy partner in foil form.

14. A method according to claim 10 wherein said another starting alloy partner in powder form is disposed between two foils of said at least one starting alloy partner.

15. A method according to claim 1 further comprising annealing said non-crystalline intermediate product to form a metallic body having a microcrystalline structure.

16. A method according to claim 1 wherein said non-crystalline intermediate product is processed into an amorphous metallic body.

17. A method according to claim 1 wherein at least one starting alloy partner is metallic and at least another starting alloy partner is a metalloid.

18. A method according to claim 1 wherein at least one starting alloy partner is an alloy.

* * * * *